US007568907B2

(12) United States Patent
Carroni et al.

(10) Patent No.: US 7,568,907 B2
(45) Date of Patent: Aug. 4, 2009

(54) COMBUSTION CHAMBER WITH BURNER AND ASSOCIATED OPERATING METHOD

(75) Inventors: Richard Carroni, Niederrohrdorf (CH); Timothy Griffin, Ennetbaden (CH)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 12/142,299

(22) Filed: Jun. 19, 2008

(65) Prior Publication Data

US 2008/0314045 A1 Dec. 25, 2008

Related U.S. Application Data

(63) Continuation of application No. PCT/EP2006/069429, filed on Dec. 7, 2006.

(30) Foreign Application Priority Data

Dec. 22, 2005 (DE) ..... 10 2005 061 486

(51) Int. Cl.
*F23D 3/40* (2006.01)

(52) U.S. Cl. ..... 431/7; 431/170

(58) Field of Classification Search ..... 60/777, 60/780, 723; 431/7, 170, 328
See application file for complete search history.

(56) References Cited

U.S. PATENT DOCUMENTS

| | | | | |
|---|---|---|---|---|
| 4,112,675 | A * | 9/1978 | Pillsbury et al. | 60/777 |
| 4,731,989 | A * | 3/1988 | Furuya et al. | 60/775 |
| 6,358,040 | B1 | 3/2002 | Pfefferle et al. | |
| 6,415,608 | B1 * | 7/2002 | Newburry | 60/723 |

FOREIGN PATENT DOCUMENTS

| | | | |
|---|---|---|---|
| DE | 4426351 | A1 | 2/1996 |
| DE | 19654022 | A1 | 6/1998 |
| DE | 10329162 | A1 | 1/2005 |
| EP | 0710797 | A2 | 5/1996 |
| EP | 0849451 | B1 | 6/1998 |
| EP | 1286112 | A1 | 2/2003 |
| EP | 1510761 | A1 | 3/2005 |
| EP | 1723369 | B1 | 11/2006 |
| WO | 2003072919 | A1 | 9/2003 |
| WO | 2004020901 | A1 | 3/2004 |
| WO | 2004020905 | A1 | 3/2004 |

* cited by examiner

*Primary Examiner*—Michael Cuff
*Assistant Examiner*—Vikansha S Dwivedi
(74) *Attorney, Agent, or Firm*—Volpe and Koenig, P.C.

(57) ABSTRACT

A method for operating a combustion chamber of a gas turbine, in particular of a power plant is provided. The combustion chamber includes at least one burner with a catalytic pilot burner. The method includes actuating the pilot burner at low power of the combustion chamber, generating a synthesis gas with a high proportion of hydrogen as a reaction product. The method further includes actuating the pilot burner at high power of the combustion chamber, generating a synthesis gas with a low proportion of hydrogen gas. An annular combustion chamber of a gas turbine, is also provided. The combustion chamber includes a plurality of burners distributed annularly. Each burner includes a catalytic pilot burner and a common air supply for the burner and the pilot burner is also provided. The common air supply distributes the supplied air with constant division between the burner and the pilot burner.

11 Claims, 2 Drawing Sheets

Fig. 1

COMBUSTION CHAMBER WITH BURNER AND ASSOCIATED OPERATING METHOD

CROSS REFERENCE TO RELATED APPLICATIONS

This application is a continuation of International Patent Application PCT/EP2006/069429 filed Dec. 7, 2006, which claims priority to German Patent Application No. 10 2005 061 486.8, filed Dec. 22, 2005, the contents of which are incorporated by reference as if fully set forth.

FIELD OF INVENTION

The present invention relates to a method for operating a combustion chamber of a gas turbine, in particular of a power plant. The invention also relates to a burner, which is provided with a catalytic pilot burner, for a combustion chamber of a gas turbine. The invention additionally relates to an annular combustion chamber which is provided with a plurality of burners of said type.

BACKGROUND

A catalytic burner is known from U.S. Pat. No. 6,358,040, which catalytic burner can generate a hydrogen-gas-containing synthesis gas from a rich fuel/air mixture during operation, and can be used as a pilot burner for a conventionally lean-operated burner of a combustion chamber of a gas turbine. By injecting a hydrogen-gas-containing synthesis gas into the burner or into a combustion space of the combustion chamber, it is possible to stabilize the homogeneous combustion reaction which takes place in the combustion space of the combustion chamber during operation. This makes it possible in particular to lower the extinguishing temperature of the combustion reaction in lean-operated burners. This makes it possible overall to reduce the combustion temperatures in the combustion space of the combustion chamber. This is particularly advantageous since the formation of nitrogen oxides increases exponentially with the reaction temperature. In order to nevertheless be able to operate the combustion chamber at higher power, the combustion chamber must be operated such that it reaches a higher outlet temperature.

SUMMARY

The present invention relates to a method for operating a combustion chamber of a gas turbine, in particular of a power plant. The combustion chamber includes at least one burner with a catalytic pilot burner. The method includes actuating the pilot burner at low power of the combustion chamber, generating a synthesis gas with a high proportion of hydrogen as a reaction product. The method further includes actuating the pilot burner at high power of the combustion chamber, generating a synthesis gas with a low proportion of hydrogen gas.

The invention also relates to a burner for a combustion chamber of a gas turbine, in particular of a power plant. The burner includes a catalytic pilot burner a common air supply for the burner and the pilot burner. The common air supply distributes the supplied air with constant division between the burner and the pilot burner. The burner also includes a fuel supply for supplying the burner with fuel and an additional fuel supply for supplying the pilot burner with fuel.

The invention further relates to an annular combustion chamber of a gas turbine, in particular of a power plant. The combustion chamber includes a plurality of burners distributed annularly, each burner including a catalytic pilot burner. Each burner also has a common air supply assigned to the burner and its pilot burner. The air supply distributes supplied air with constant division between the burner and the pilot burner. The pilot burners, during operation of the combustion chamber, generate a hydrogen-gas-containing synthesis gas and introduce it into a mixture formation space of the associated burner and/or into a combustion space of the combustion chamber which is arranged downstream of the mixture formation spaces of the burner.

BRIEF DESCRIPTION OF THE DRAWINGS

Preferred exemplary embodiments of the invention are illustrated in the drawings and are explained in more detail in the following description, with the same reference symbols denoting identical or similar or functionally identical components. The figures show, in each case schematically.

DETAILED DESCRIPTION OF THE PREFERRED EMBODIMENTS

Introduction to the Embodiments

Figure 1:
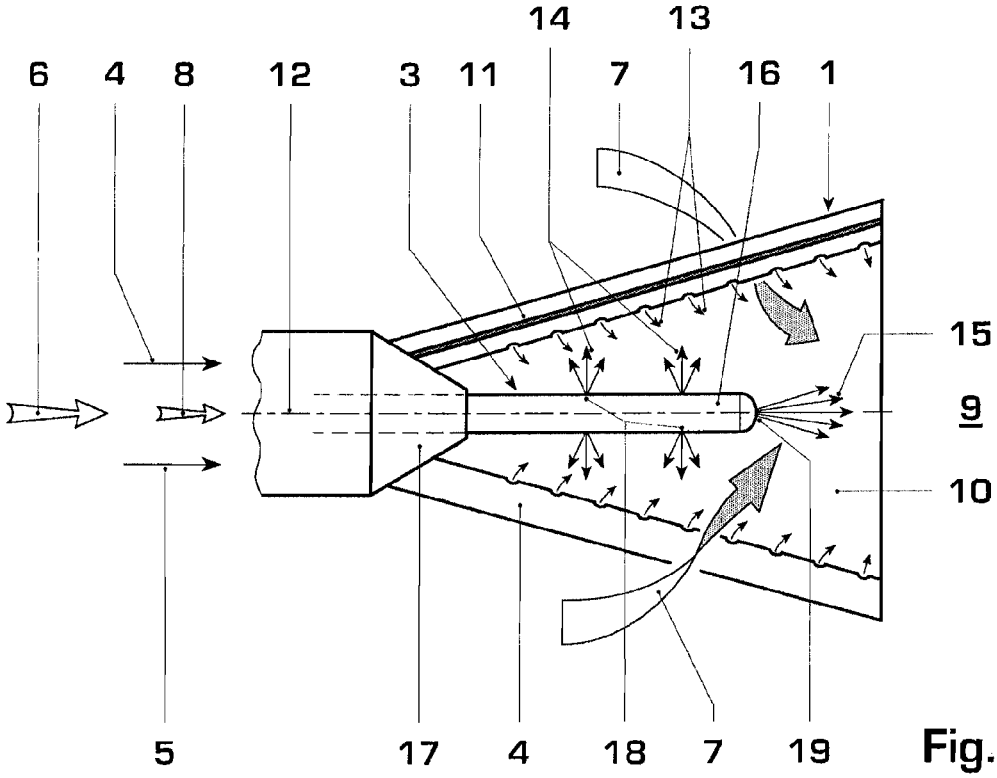
FIG. 1 is a highly simplified diagrammatic longitudinal section through a burner according to the invention.

The invention is concerned with a way of obtaining reliable operation and low pollutant emissions at varying levels of combustion chamber power.

The method according to the invention is based on the general concept of actuating the pilot burner as a function of the combustion chamber power in such a way that the synthesis gas generated by said pilot burner contains a relatively high proportion of hydrogen gas at low combustion chamber power, while containing a relatively low proportion of hydrogen gas at comparatively high combustion chamber power. Here, the invention utilizes the knowledge that synthesis gas with a relatively low proportion of hydrogen gas relatively considerably reduces the formation of nitrogen oxides at high flame temperatures. It is simultaneously not necessary to reduce the extinguishing limit at high flame temperatures. In contrast, a synthesis gas with a high proportion of hydrogen gas would increase the pollutant emissions, in particular the nitrogen oxide emissions, at high flame temperatures. The invention additionally utilizes the knowledge that at low flame temperatures, the injection of synthesis gas with a relatively high proportion of hydrogen gas significantly stabilizes the homogeneous combustion reaction, by virtue of the extinguishing limit being lowered considerably. This does not simultaneously lead to an increase in the formation of nitrogen oxide.

The operating method according to the invention therefore leads to stabilized operation of the combustion chamber at comparatively low combustion chamber power, for example at low load or part load, while at relatively high combustion chamber power, for example at full load, the pollutant emissions are simultaneously reduced in comparison to those during operation without a pilot burner.

According to one advantageous embodiment, the synthesis gas generation of the pilot burner can be controlled by the fuel quantity supplied to the pilot burner, while the air quantity supplied to the pilot burner is simultaneously kept constant.

The hydrogen gas proportion in the synthesis gas is therefore controlled by the fuel/air ratio supplied to the catalytic pilot burner. Such an approach makes it possible to save on expensive regulating devices and control devices for the air supply to the pilot burner.

This makes it possible for a common air supply to be provided for the burner and the associated pilot burner, which common air supply distributes the supplied air with constant division between the burner and the associated pilot burner. A burner designed in this way can be provided comparatively cost effectively, since it is possible to dispense with said regulating devices and control devices for the air supply to the pilot burner.

In another important embodiment, the burner according to the invention is embodied such that a relatively large proportion of the synthesis gas is introduced into the burner and/or into the combustion chamber radially relative to a longitudinal axis of the respective burner, while a relatively small proportion of the synthesis gas is introduced into the burner and/or into the combustion chamber axially relative to the longitudinal axis. It has been shown that the best results in terms of pollutant emissions and combustion stabilization can be obtained when the synthesis gas is introduced predominantly radially.

DETAILED DESCRIPTION

Figure 2B:
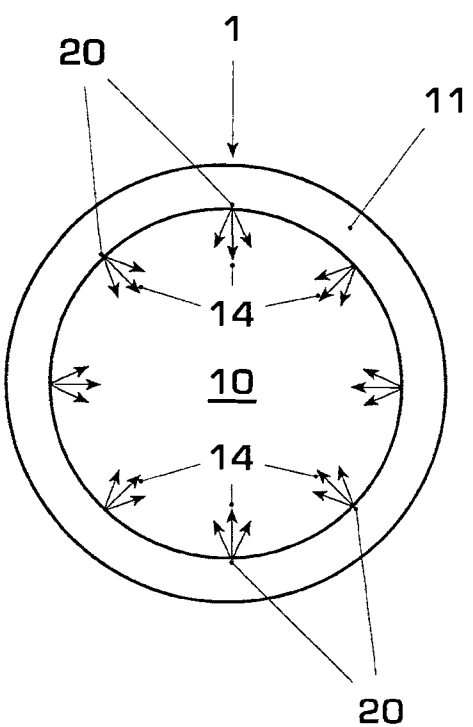
FIG. 2*b* is a cross section through the burner from FIG. 2*a*.
Figure 2A:
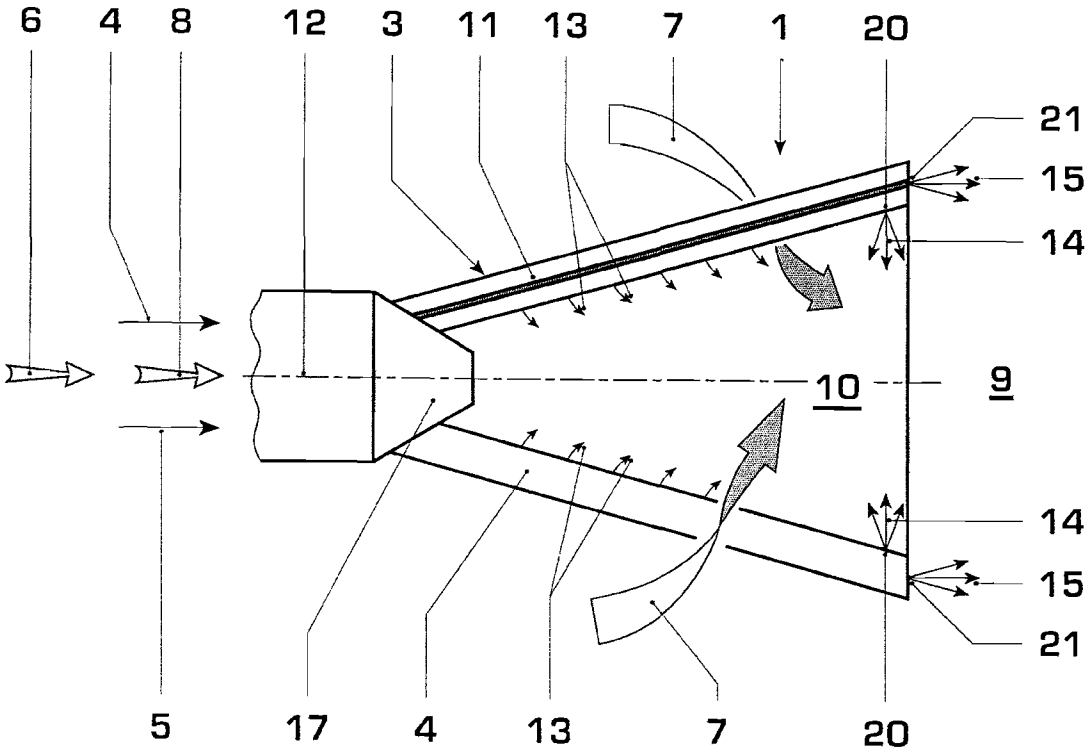
FIG. 2*a* is a longitudinal section, like that in FIG. 1, but of another embodiment.

In FIGS. 1 and 2*a*, a burner 1, according to the invention, of a combustion chamber 2 (cf. FIG. 3) comprises a catalytically working pilot burner 3. The burner 1 comprises a fuel supply 4 which is indicated here simply by an arrow and, during operation of the burner 1, supplies the latter with fuel. Also provided is an additional fuel supply 5, which is likewise indicated by an arrow and, during operation of the burner 1, supplies the pilot burner 3 with fuel. Also provided is an air supply 6 which is common to the burner 1 and its pilot burner 3. Said common air supply 6 is designed, in a way that would be understood by a person of ordinary skill in the art in view of this disclosure, such that it distributes the supplied air between the burner 1, see arrows 7, and the pilot burner 3, see arrow 8.

The burner 1 serves to generate a homogeneous combustion reaction in a combustion space 9 of the combustion chamber 2, which combustion space 9 is arranged downstream of the burner 1 in the assembled state. The combustion chamber 2 itself serves to generate hot gases for acting on a gas turbine, in particular of a power plant.

The burner 1 also has a mixture formation space 10 which, in the assembled state, is open towards the combustion space 9. The air supply 6 introduces the air quantity 7 assigned to the burner 1 into said mixture formation space 10. Here, the said air is introduced in a tangential flow via axially aligned gaps in the burner wall 11 which encloses the mixture formation space 10 peripherally with respect to a longitudinal axis 12 of the burner 1. Likewise in the region of the axial gaps for introducing the combustion air, the fuel supply 4 leads the fuel quantity assigned to the burner 1 to the mixture formation space 10, as indicated here by a plurality of arrows 13. Here, the fuel supply 4 extends within the burner wall 11. A burner 1 of said type is conventionally operated lean in order to obtain a combustion reaction in the combustion space 9 with the lowest possible level of pollutants.

The catalytically working pilot burner 3 is supplied, by the air supply 6, with a certain proportion of the total air quantity supplied to the burner 1, specifically the partial air quantity 8. The additional fuel supply is now actuated such that a rich fuel/air mixture is produced, with this rich fuel/air mixture being supplied to the pilot burner 3. As a result of the selection of the respective fuel/air ratio and the associated operating parameters, the fuel is partially oxidized in the catalytic converter of the pilot burner 3, in the process of which a hydrogen-gas-containing synthesis gas is produced as a combustion exhaust gas. Said synthesis gas is then introduced, corresponding to arrows 14 and 15, from the pilot burner 3 into the mixture formation space 10 or into the combustion space 9. A partial quantity of the synthesis gas is introduced, corresponding to the arrows 14, into the mixture formation space 10 substantially radially relative to the longitudinal axis 12. In contrast, another partial quantity of the synthesis gas is injected, corresponding to the arrows 15, into the mixture formation space 10 or into the combustion space 9 substantially axially relative to the longitudinal axis 12.

According to the invention, the radially introduced synthesis gas proportion 14 is larger than the axially introduced synthesis gas proportion 15. This specific division of the introduction of synthesis gas into the mixture formation space 10 or into the combustion space 9 is based on the knowledge that said division of the injection of synthesis gas makes it possible to obtain particularly favorable results for low nitrogen oxide production and for a stabilizing action for the homogeneous combustion reaction in the combustion space 9. Here, according to one preferred embodiment, the pilot burner 3 can for example be designed such that at least 50% to 70% of the synthesis gas generated by the pilot burner 3 enters the mixture formation space 10 radially. Accordingly, the proportion of synthesis gas introduced from the pilot burner 3 into the mixture formation space 10 or into the combustion space 9 axially is at most 30% to 50%.

In addition, it can be expedient to also design the pilot burner 3 such that the radially introduced synthesis gas quantity 14 at least partially also has a tangential component relative to the longitudinal axis 12.

The pilot burner 3 can, corresponding to the embodiment in FIG. 1, have a lance 16. Here, the lance 16 extends coaxially with respect to the longitudinal axis 12 of the burner 1. In addition, the lance 16 projects axially from a burner head 17, and protrudes into the mixture formation space 10. To provide the radial and axial injection of the synthesis gas into the mixture formation space 10 and/or into the combustion space 9, the lance 16 has corresponding radial outlet openings 18 (only partially indicated here) and at least one axial outlet opening 19.

In another embodiment, the burner 1 can alternatively have a pilot burner 3 which is integrated into the burner wall 11, corresponding to FIGS. 2*a* and 2*b*. A catalytically active duct, for example, is integrated into the burner wall 11 for this purpose. It is likewise possible to arrange a catalytic converter further upstream and to only integrate the exhaust gas ducts into the burner wall 11, which exhaust gas ducts then transport the synthesis gas. In any case, the burner wall 11 comprises a plurality of radial outlet openings 20 through which the relatively large, radial synthesis gas proportion 14 enters into the mixture formation space 10. The burner wall 11 also comprises a plurality of axial outlet openings 21 through which the relatively small, axial synthesis gas proportion 15 can then be injected into the combustion space 9.

With regard to the fuel supply 4 and the air supply 7 of the burner 1, the burner 1 shown in FIG. 2*a* operates in substantially the same way as the burner 1 shown in FIG. 1, with the radial fuel injection 13 being represented in simplified form in FIG. 2*a*.

Figure 3:
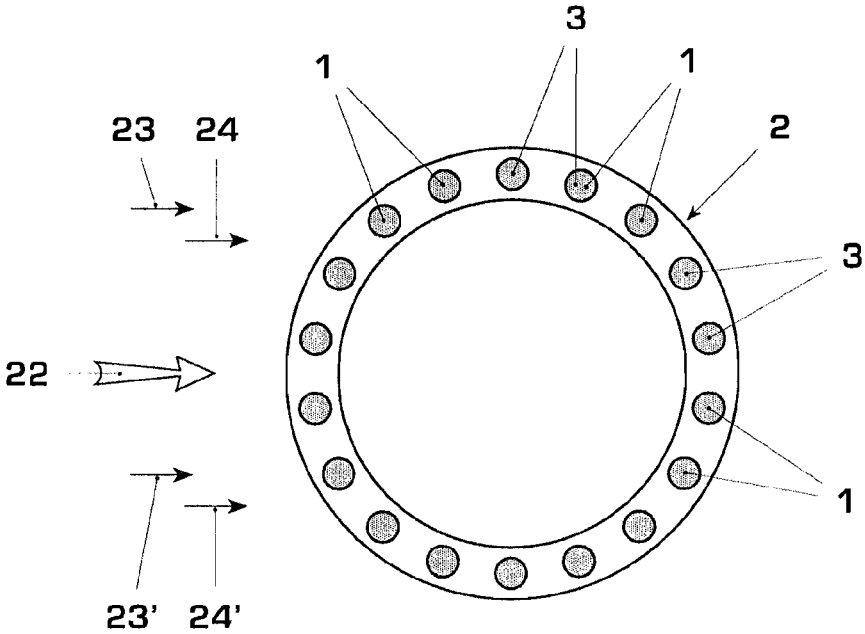
FIG. 3 is a highly simplified axial view of an annular combustion chamber according to the invention.

Corresponding to FIG. 3, a combustion chamber 2, which is embodied according to the invention as an annular combustion chamber, comprises a plurality of burners 1 which are arranged so as to be distributed annularly upstream of the combustion space 9 (see FIGS. 1*a* and 2*a*). Each of said burners 1 is provided with a pilot burner 3 which works catalytically and can generate hydrogen-gas-containing synthesis gas. Conventionally, a common air supply 22 is provided for all the burners 1, said air supply 22 being indicated here by an arrow. In addition, the burners 1 are conventionally organized in groups for the supply of fuel. For example, two burner groups are provided, each of which is assigned half of all the burners 1. Each burner group has a separate fuel supply 23 and 23' respectively. The burners 1 of one group are expediently arranged alternately with the burners 1 of the other group. In a corresponding way, the pilot burners 3 of one group can be supplied with fuel by a common additional fuel supply 24, while the pilot burners 3 of the other burner group are supplied with fuel by a further common additional fuel supply 24'. The air supply within the individual burners 1 is again common, specifically with constant division of the supplied air quantity between the respective burner 1 and the associated pilot burner 3.

According to the invention, the burners 1 in the combustion chamber 2 can be operated as follows:

If the combustion chamber 2 is to generate a relatively low combustion chamber power, the fuel supply 23 and 23' of the burners 1 is correspondingly reduced. In addition, the pilot burners 3 are actuated such that they each generate a synthesis gas which contains a relatively high proportion of hydrogen gas. Said synthesis gas is introduced by the pilot burner 3 into the mixture formation space 10 of the burners 1 or into the combustion space 9 of the combustion chamber 2, and there lowers the extinguishing limit as a result of its high hydrogen gas proportion. In the experiment, it was possible to lower the extinguishing limit to approximately 100K. In this way, the combustion reaction can take place in a stable manner in the combustion space 9 even if the temperature in the combustion space 9 is comparatively low as a result of the reduced combustion chamber power. For example, a low combustion chamber power is characterized by an outlet temperature of the combustion exhaust gases from the combustion chamber 9 of a maximum of 1600 K. Here, despite the relatively high hydrogen gas proportion, the low combustion space temperatures do not lead to an increase in nitrogen oxide formation.

In the event that the combustion chamber 2 is to output a relatively high combustion chamber power, the burner 1 is supplied with a correspondingly increased fuel quantity. In addition, the pilot burners 3 are actuated such that the synthesis gas generated by them contains a relatively low proportion of hydrogen gas. The increased fuel supply via the burners 1 leads to an increase of the temperature in the combustion space 9, causing an increase in the combustion chamber power. At high combustion space temperatures, the comparatively low hydrogen gas proportion in the synthesis gas leads to a significant reduction in the nitrogen oxide formation. Accordingly, it is possible for the pollutant emissions to be considerably reduced by the synthesis gas injection. In the experiment, the nitrogen oxide formation could be reduced by approximately 33%.

At low combustion chamber power, the synthesis gas injected by the pilot burners 3 preferably contains a hydrogen gas proportion of at least 30% by volume. At low combustion chamber power, the hydrogen gas component is preferably between 30% by volume and 50% by volume. In contrast, at high combustion chamber power, the hydrogen gas proportion in the synthesis gas is preferably a maximum of 30% by volume, in particular in a range from 5% by volume to 30% by volume.

With the catalytically working pilot burners 3, the synthesis gas production and the hydrogen gas proportion in the synthesis gas can be altered in a particularly simple manner by varying the fuel/air ratio. Said fuel/air ratio can itself be altered in a particularly simple manner by varying the fuel quantity supplied to the pilot burners 3, which is relatively simple to do. In contrast, the air quantity supplied remains substantially constant, so that it is possible here to dispense with expensive control devices and regulating devices.

The operating mode according to the invention of the combustion chamber 2 and of its burners 1 makes it possible for the combustion chamber 2 to be operated in a comparatively stable fashion at low power, while the production of nitrogen oxides is also considerably reduced at high combustion chamber power.

The integration of pilot burners 3 into the burner 1 of the annular combustion chamber 2 also has an additional valuable advantage. In annular combustion chambers 2, there are conventionally undesired interactions among the individual burners 1. Said interactions can lead to pulsations and therefore to undesirable vibrational loading of the components and to the environment being subjected to undesirable noise. In addition, the interactions can reduce the stability of the combustion reactions, increase local temperatures and therefore assist the formation of nitrogen oxides.

A cause of said undesirable interactions is considered to be that of the common air supply to the burners 1 of the same burner group not supplying the individual burners 1 with exactly the same air quantity, which can be attributed, for example, to production tolerances. In order to compensate for this, it is fundamentally possible for the air supply and/or the fuel supply for each burner 1 to be controlled separately. This, however, entails an enormous expenditure. This is remedied according to the invention by providing the burners 1 with the pilot burners 3.

As mentioned, the air quantity supplied to the individual burners 1 can deviate from an ideal air quantity or nominal air quantity. Since—as mentioned above—the division of the air quantity supplied to the individual burners 1 between the burner 1 and its pilot burner 3 is constant, the air quantity supplied to the individual pilot burner 3 varies in the same ratio as the total air quantity supplied to the individual burner 1. If the total air quantity or actual air quantity actually supplied to the individual burner 1 then deviates from the desired nominal air quantity, then the air quantity supplied to the respective pilot burner 3 also changes as a result. Since, in steady-state operation of the combustion chamber 2, the fuel quantity supplied to the pilot burner 3 remains constant, a change in the air quantity leads to a change in the fuel/air ratio. The fuel/air ratio, however, correlates with the synthesis gas production and with the hydrogen gas proportion in the synthesis gas generated by the catalytic pilot burners 3.

In the event that the actual air quantity is greater than the nominal air quantity, the combustion-air/fuel ratio increases. An increased combustion-air/fuel ratio increases the hydrogen gas proportion in the synthesis gas and leads to an increased exhaust gas temperature of the respective pilot burner 3, that is to say to an increased synthesis gas temperature. This leads to that section of the flame front in the combustion space 9 which is assigned to said burner 1 and said pilot burner 3 being moved upstream. Said local change in the position of the flame front increases the pressure drop across said burner 1, that is to say the flow resistance of the latter, and leads as a result to a reduction in the air quantity supplied to said burner 1. In this way, the actual air quantity decreases and approaches the nominal air quantity.

If, on the other hand, the actual air quantity is lower than the nominal air quantity, the combustion-air/fuel ratio falls. This leads to the associated flame front section being moved downstream, resulting in the pressure loss through said burner 1 correspondingly decreasing. As a result, the air flow through said burner 1 can increase again, and the actual air quantity increases.

As a result, therefore, the air quantity is individually and automatically regulated at each individual burner 1 to a value previously defined during the design of the respective burner 1. Expensive regulation strategies, devices and the like are not required.

At the same time, it is possible for acoustic interactions to be reduced by the pilot burners 3 by virtue of the synthesis gas being introduced into the combustion space 9. This is because the supply of highly reactive fuels leads to a reduction in acoustic interactions.

LIST OF REFERENCE SYMBOLS

1 Burner
2 Combustion chamber
3 Pilot burner
4 Fuel supply
5 Additional fuel supply
6 Air supply
7 Air quantity proportion for 1
8 Air quantity proportion for 3
9 Combustion space
10 Mixture formation space
11 Burner wall
12 Longitudinal axis of 1
13 Fuel quantity
14 Radial synthesis gas injection
15 Axial synthesis gas injection
16 Lance
17 Burner head
18 Radial outlet opening
19 Axial outlet opening
20 Radial outlet opening
21 Axial outlet opening
22 Air supply
23 Fuel supply
24 Additional fuel supply

What is claimed is:

1. A method for operating a combustion chamber (2) of a gas turbine, in particular of a power plant, the combustion chamber (2) having at least one burner (1) which is provided with a catalytic pilot burner (3), the method comprising:

actuating the pilot burner (3) at low power of the combustion chamber such that it generates, as a reaction product, a synthesis gas with a high proportion of hydrogen gas, actuating the pilot burner (3) at high power of the combustion chamber (2) such that the synthesis gas generated has a low proportion of hydrogen gas.

2. The method as claimed in claim 1, wherein at low combustion chamber power, the synthesis gas contains a proportion of at least 30% by volume of hydrogen gas.

3. The method as claimed in claim 2, wherein at low combustion chamber power, the hydrogen gas proportion in the synthesis gas is between 30% by volume and 50% by volume.

4. The method as claimed in claim 1, wherein the synthesis gas at high combustion chamber power contains up to 30% by volume of hydrogen gas.

5. The method as claimed in claim 4, wherein at high combustion chamber power, the hydrogen gas proportion in the synthesis gas is between 5% by volume and 30% by volume.

6. The method as claimed in claim 1, wherein at least one of at low combustion chamber power, the combustion chamber (2) has an outlet temperature of a maximum of 1600 K, or at high combustion chamber power, the combustion chamber (2) has an outlet temperature of at least 1800 K.

7. The method as claimed in claim 1, wherein a first proportion (14) of the synthesis gas is introduced into at least one of the burner (1) or into the combustion chamber (2) radially relative to a longitudinal axis (12) of the respective burner (1); and a second proportion (15), less than the first portion, of the synthesis gas is introduced into at least one of the burner (1) or into the combustion chamber (2) axially relative to the longitudinal axis (12).

8. The method as claimed in claim 7, wherein a proportion of the synthesis gas of at least 50% to 70% is introduced radially, and a proportion of the synthesis gas of at most 30% to 50% is introduced axially.

9. The method as claimed in claim 7, wherein the radially introduced synthesis gas at least partially also has a tangential component relative to the longitudinal axis (12).

10. The method as claimed in claim 1, wherein the burner (1) and the associated pilot burner (3) are provided with a common air supply (6) with constant division of the air between the burner (1) and the pilot burner (3).

11. The method as claimed in claim 1, wherein the synthesis gas generation of the pilot burner (3) is controlled by the fuel quantity supplied to the pilot burner (3), while the air quantity supplied to the pilot burner (3) is kept constant.

* * * * *